US006181282B1

(12) United States Patent
Gans et al.

(10) Patent No.: US 6,181,282 B1
(45) Date of Patent: Jan. 30, 2001

(54) ANTENNA AND METHOD OF MAKING SAME

(75) Inventors: Lawrence Steven Gans, Exeter; James Matthew Skladany, Somersworth, both of NH (US); John Eugene Westman, Harrisburg, PA (US)

(73) Assignee: Tyco Electronics Corporation, Wilmington, DE (US)

( * ) Notice: Under 35 U.S.C. 154(b), the term of this patent shall be extended for 0 days.

(21) Appl. No.: 09/494,109

(22) Filed: Jan. 28, 2000

(51) Int. Cl.[7] ..... H01Q 1/38
(52) U.S. Cl. ..... 343/700 MS; 343/702
(58) Field of Search ..... 343/895, 700 MS, 343/702; 455/90

(56) References Cited

U.S. PATENT DOCUMENTS 5,594,455 * 1/1997 Hori et al. ..... 343/700 MS
6,040,803 * 3/2000 Spall ..... 343/700 MS
6,100,848 * 8/2000 Hayes ..... 343/702

* cited by examiner

*Primary Examiner*—Don Wong
*Assistant Examiner*—James Clinger

(57) ABSTRACT

An antenna (10) includes a dielectric substrate (12) having a base (14) and an extended portion (18). An active antenna element (32) is disposed on one surface (30) of the extended portion (18) and a parasitic element (22) is disposed on an opposed surface (20). The substrate (12) with the elements disposed thereon is encapsulated in dielectric material using a two step molding process. In the first molding step at least one protrusion (42) is formed on each surface (20, 30) of the substrate (12). The protrusions (42) are used to precisely position the subassembly (11) in a second mold cavity for molding dielectric material over the remaining surfaces of the substrate (12).

11 Claims, 2 Drawing Sheets

ANTENNA AND METHOD OF MAKING SAME

FIELD OF THE INVENTION

This invention is directed to antennae and more particularly to dual band antennae.

BACKGROUND OF THE INVENTION

The cellular communications industry including cellular telephones and the like use a range of frequencies between 800 and 900 megahertz (MHz). Cellular telephones, pagers, and the like generally use a whip or stub antenna that is tuned to provide optimum performance in the above frequency range. With the advent of personal communications services (PCS) for providing services such as data transmission, wireless voice mail, and the like, the Federal Communications Commission (FCC) has established a center frequency of 1.92 gigahertz (GHz) with a suitable band width, well known to one skilled in the art. As the new PCS technology expands, there is a need to provide devices that can receive and transmit communications in both the 800–900 MHz and 1.85 to 1.99 GHz frequency ranges. Cellular telephones and the like, therefore, need to have antennae that will operate at each of the two frequency ranges. One way to achieve this is to provide two separate antennae. It is more desirable and economical, however, to provide a single antenna having at least dual band capability.

Additionally it is desirable to have an antenna that is compact, flexible, resistant to impact and is protected from the environment.

SUMMARY OF THE INVENTION

This invention is directed to a dual band antenna that includes a substantially flat dielectric substrate having a base and an extended portion. An active antenna element is disposed on one surface of the extended portion and a parasitic element is disposed on an opposed surface. The active element has a selected design, shown representatively as a serpentine pattern having first and second ends, the first end being a feed point that extends into the base. The parasitic element is disposed in an essentially straight line and extends between a selected portion of the serpentine pattern. The base further includes a ground plate on the same side as the parasitic element.

The antenna is encapsulated in a dielectric material to provide both environmental and mechanical protection for the antenna. The encapsulation is accomplished in a two step molding process. In the first molding step at least one protrusion is formed on each surface of the substrate forming a subassembly. The protrusions are used to precisely position the subassembly in a second mold cavity for molding a layer over the remaining surfaces of the substrate. Using the protrusions to position the antenna subassembly in the second cavity eliminates the need for metal positioning pins that leave holes when the completed antenna is removed from the mold. Additionally the materials used in the two step process may be of different durometers thus, for example, providing a flexible edge and a stiffer body.

An embodiment of the invention will now be described by way of example with reference to the accompanying drawings.

DETAILED DESCRIPTION OF AN EMBODIMENT OF THE INVENTION

Figure 1:
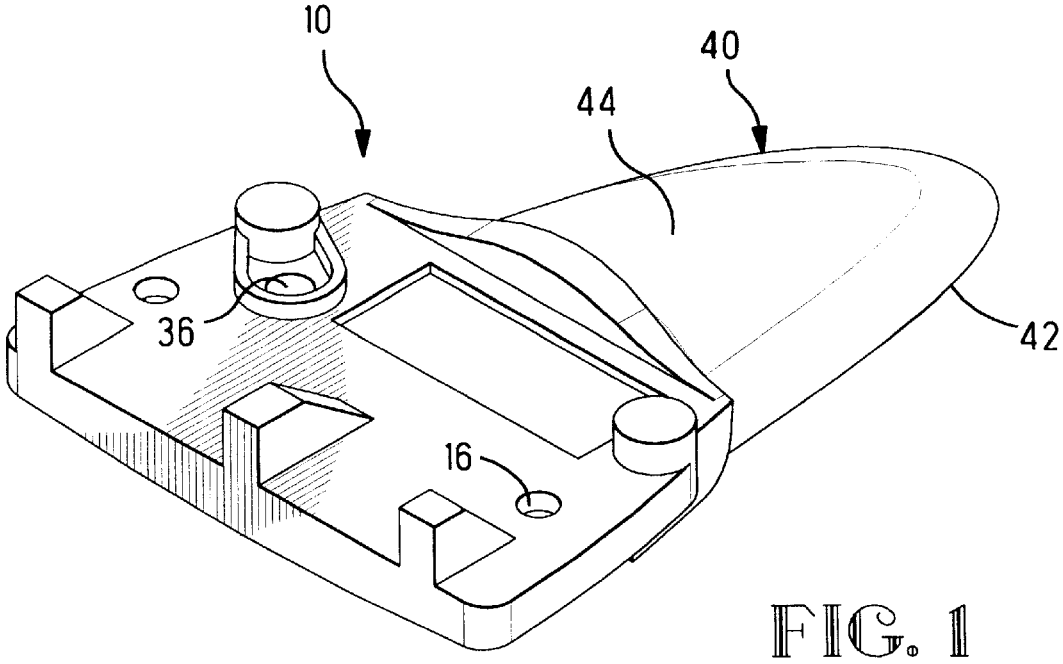
FIG. 1 is an assembled view of the antenna of the present invention.
Figure 2:
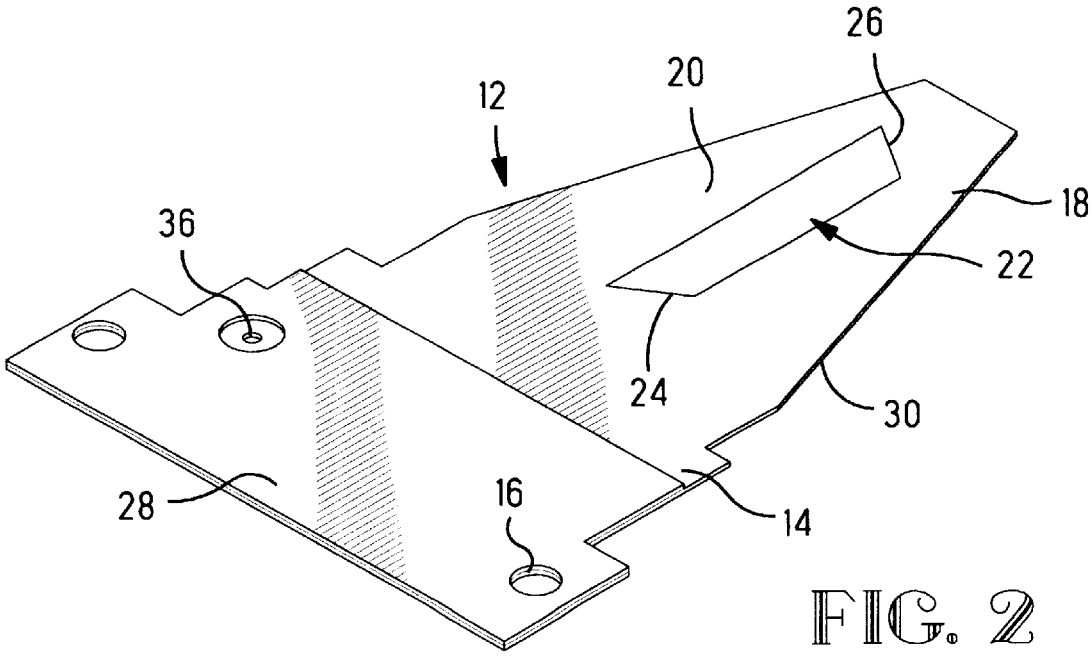
FIG. 2 is a view of one surface of the antenna of FIG. 1 with the dielectric outer layer removed.
Figure 3:
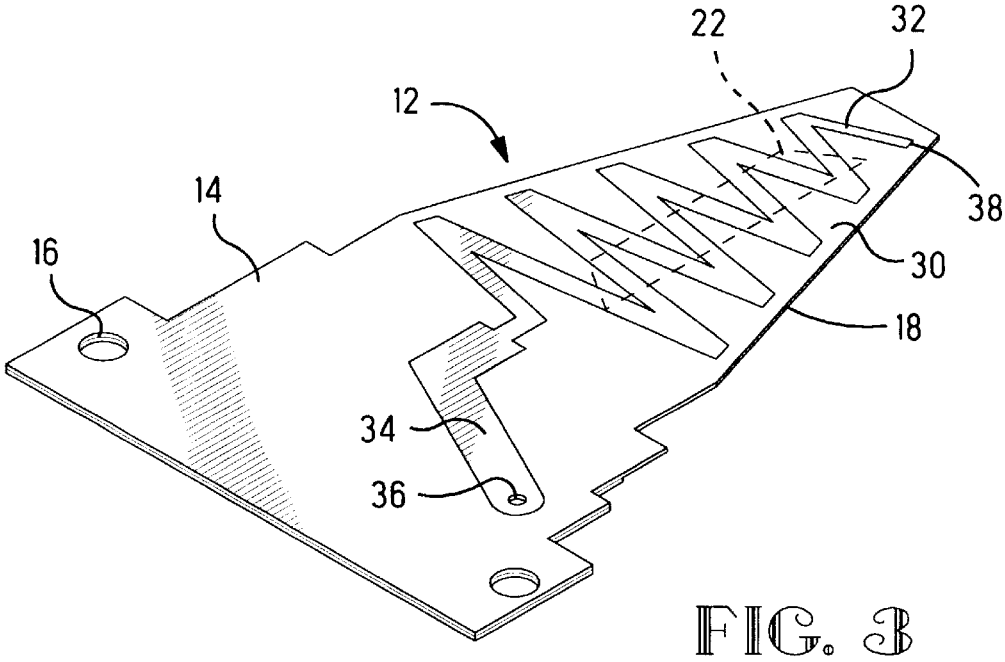
FIG. 3 is a view of the other surface of the antenna of FIG. 1 with the dielectric outer layer removed.
Figure 4:
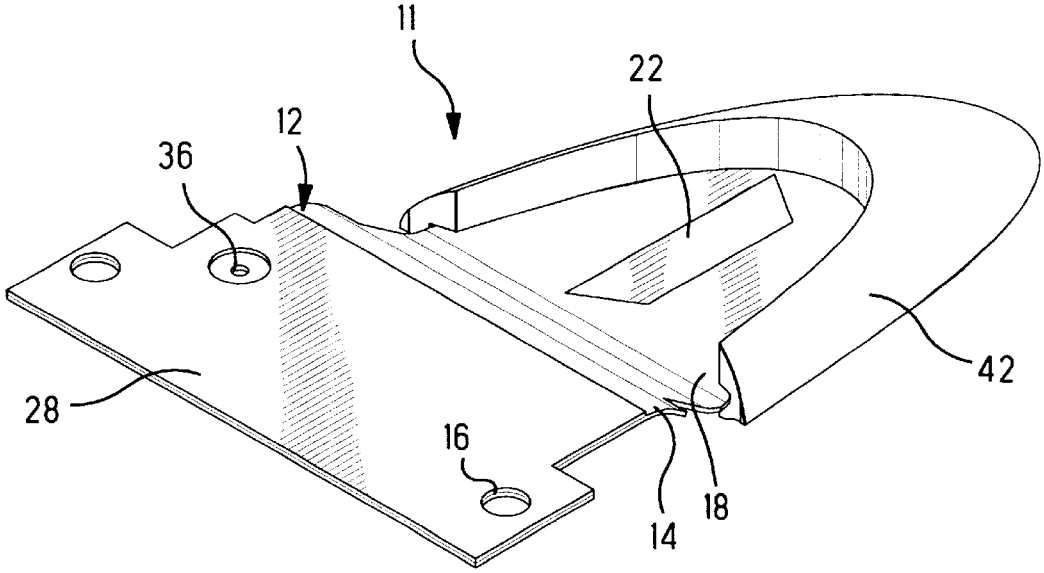
FIG. 4 is a view of the antenna after the first molding step has been completed.

Referring now to FIGS. 1 through 4, antenna assembly 10 includes substrate 12 having a parasitic element 22 and an active element 32 disposed on opposed surfaces 20, 30 thereof and a dielectric cover molded around the substrate 12. Substrate 12 includes a base 14 and an extended portion 18, as best seen in FIGS. 2 through 4. Base 14 includes mounting apertures 16 and a conductive area 28 defining a ground for the antenna. Substrate 12 may be rigid or flexible. First surface 20 of portion 18 includes a parasitic antenna element 22 shown as an essentially straight conductive trace disposed thereon and having ends 24, 26. Second surface 30 of portion 18 includes an active antenna element 32 shown as a serpentine or zig-zag conductive trace disposed thereon and having first and second ends 34, 38. First end 34 extends along surface 30 and into the base 14, ending at a feed point 36 for the antenna, as can be seen in FIG. 3. FIG. 3 also illustrates the relative position of parasitic element 22 (shown in phantom) with respect to active element 32. Capacitive coupling occurs between the two elements 22 and 32 along the length of the overlapped portions. The elements 22 and 32 may be disposed on substrate surfaces 20 and 30 by an etching process or other methods as known in the art. It is to be recognized that the patterns of the two elements and the relative lengths thereof are not limited to the representative patterns shown. The antenna is tuned by varying the length, width and shape of the active element 32 and the size and shape of the parasitic element 22. The characteristic impedance of the antenna is determined by the width and length of the first end 36 of the active element proximate the feed point.

FIGS. 4 and 1 illustrate the method of molding the dielectric material 40 around the substrate 12 after the conductive elements have been disposed thereon. The molding process occurs in two steps. The first step is illustrated in FIG. 4 wherein a rib 42 or other protrusions such as a plurality of bosses are molded along portions of the extending portion 18 forming subassembly 11. In the second step of the molding, the ribs 42 are used to position subassembly 11 in the mold cavity while a second material 44 is disposed around the entire subassembly, filling in the areas between the protrusions 42 to form a smooth surface. This two step process eliminates the need to use support pins for the substrate as would be necessary in a single step molding process. The support pins form voids in the overmolded surface, which may allow moisture or environmental contaminants to reach the substrate. Additionally the two step process allows the use of two materials, each having a different durometer. For example, the ribs 42 may be made of a lower durometer material and the second material may have a higher durometer to provide further strength and impact resistance for the antenna. The materials used need to be compatible, such that the second material will adhere to the first material to seal the interface therebetween the two materials.

Antenna 10 is electrically connected to the circuitry of a cell telephone or the like at the feed point by means known in the art. Screws or other fastening devices are inserted through mounting apertures 16 to secure the antenna to the chassis of the telephone. Antenna 10 provides a compact antenna having dual band capability and impact resistance.

It is thought that the antenna of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An antenna comprising:

a dielectric substrate having opposite major surfaces;

an active antenna element disposed in a first selected design on one of said surfaces, said active element having first and second ends with said first end being a feed point;

a parasitic antenna element disposed in a second selected design on the other of said surfaces, said parasitic element extending to first and second free ends, said parasitic element underlying at least portions of said active element; and a ground conductor disposed on said other surface spaced from said first free end of said parasitic element.

2. The antenna of claim 1 wherein said first selected design is a serpentine pattern.

3. The antenna of claim 1 wherein said second selected design is essentially a straight line.

4. The antenna of claim 1 wherein said substrate is flexible.

5. The antenna of claim 1 wherein said substrate is rigid.

6. A method of making an antenna comprising the steps of:

disposing an active antenna element in a first selected design on one surface of a dielectric substrate;

disposing a parasitic antenna element in a second selected design on an opposed surface of said substrate, such that said parasitic element underlies at least portions of said active element;

forming at least one dielectric protrusion on each of said surfaces of said substrate defining a subassembly having at least two protrusions extending outwardly therefrom;

positioning said subassembly in a mold cavity by use of said protrusions; and encapsulating the remaining portions of the substrate and antenna elements with dielectric material.

7. The method of claim 6 wherein said protrusions are formed from a dielectric material having a first selected durometer and said dielectric material for said encapsulation has a second selected durometer.

8. The method of claim 7, wherein the first selected durometer is lower than the second selected durometer.

9. A method of making an antenna comprising the steps of:

applying conductive elements to a substrate having opposite surfaces;

forming a rib about at least a portion of a periphery of the substrate to define a subassembly;

positioning said subassembly in a mold cavity by use of said rib; and encapsulating the remaining portions of the substrate and conductive elements with dielectric material.

10. The method of claim 9, wherein said rib is formed of a dielectric material having a first selected durometer and said dielectric material for encapsulation of said remaining portions of said substrate and conductive elements has a second selected durometer.

11. The method of claim 10, wherein said first selected durometer is lower than said second selected durometer.

* * * * *